US006672035B1

(12) United States Patent
Simonsen et al.

(10) Patent No.: US 6,672,035 B1
(45) Date of Patent: Jan. 6, 2004

(54) METHOD FOR SHOCK-RESISTANT PACKAGING OF A PRODUCT AND A PLANE CARDBOARD BLANK FOR CARRYING OUT THE METHOD

(75) Inventors: Lars Simonsen, Sædding (DK); Jens Aalborg Nielsen, Mølle (DK); Hans Gram Andersen, Felding (DK)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 09/831,756

(22) PCT Filed: Nov. 12, 1999

(86) PCT No.: PCT/DK99/00623

§ 371 (c)(1),
(2), (4) Date: Jul. 17, 2001

(87) PCT Pub. No.: WO00/29290

PCT Pub. Date: May 25, 2000

(30) Foreign Application Priority Data

Nov. 12, 1998 (DK) ..... 1998 01475

(51) Int. Cl.[7] ..... B65B 43/08

(52) U.S. Cl. ..... 53/456; 53/139.5; 53/170; 53/462; 53/472; 206/460; 206/521; 206/813

(58) Field of Search ..... 53/445, 456, 472, 53/474, 139.5, 128.1, 410, 170, 207, 462, 218, 219; 206/460, 813, 521

(56) References Cited

U.S. PATENT DOCUMENTS

| | | | | | |
|---|---|---|---|---|---|
| 2,011,703 | A | * | 8/1935 | Barker | 229/87 |
| 2,191,704 | A | * | 2/1940 | Bennett | 156/230 |
| 2,532,011 | A | * | 11/1950 | Dahlquist et al. | 428/40.1 |
| 2,744,624 | A | * | 5/1956 | Hoogstoel et al. | 206/426 |
| 3,388,524 | A | * | 6/1968 | Fellner et al. | 53/461 |
| 3,891,090 | A | | 6/1975 | Spiegel et al. | |
| 4,627,223 | A | * | 12/1986 | Janhonen | 53/449 |
| 4,653,252 | A | * | 3/1987 | van de Haar et al. | 53/449 |
| 4,757,900 | A | | 7/1988 | Misset et al. | |
| 5,092,465 | A | * | 3/1992 | Weder et al. | 206/423 |
| 5,127,525 | A | * | 7/1992 | Hummer | 206/586 |
| 5,240,109 | A | | 8/1993 | Weder et al. | |
| 5,732,823 | A | * | 3/1998 | Weder et al. | 206/423 |

FOREIGN PATENT DOCUMENTS

| | | | | |
|---|---|---|---|---|
| DE | 93 12 834.7 | | 2/1994 | |
| DE | 44 38 699 | | 5/1996 | |
| EP | 0 686 577 | | 12/1995 | |
| GB | 2 179 026 | | 2/1987 | |
| GB | 2 291 859 | | 2/1996 | |
| GB | 2291859 | * | 2/1996 | B65D/25/10 |

OTHER PUBLICATIONS

English translation of Citation 1—Taiwanese Publication No. 195288.
English translation of Citation 2—Taiwanese Publication No. 278466.

* cited by examiner

*Primary Examiner*—Rinaldi I. Rada
*Assistant Examiner*—Thanh Truong
(74) *Attorney, Agent, or Firm*—Venable LLP; John P. Shannon

(57) ABSTRACT

A product (18) is packed in a shock-resistant way in a box-shaped cardboard packing (20) by local application of an adhesive layer (16) on a base surface (17) of a plane cardboard blank, with which layer the product (18) is brought into contact and subsequently the cardboard packing (20) is completed by folding up the other elements of the plane blank (1) and closure of the packing. The plane cardboard blank may be made as a separate packing unit with adhesive layers in the form of adhesive tapes with an outward adhesive surface covered by a protective layer.

11 Claims, 3 Drawing Sheets

Figure 1:
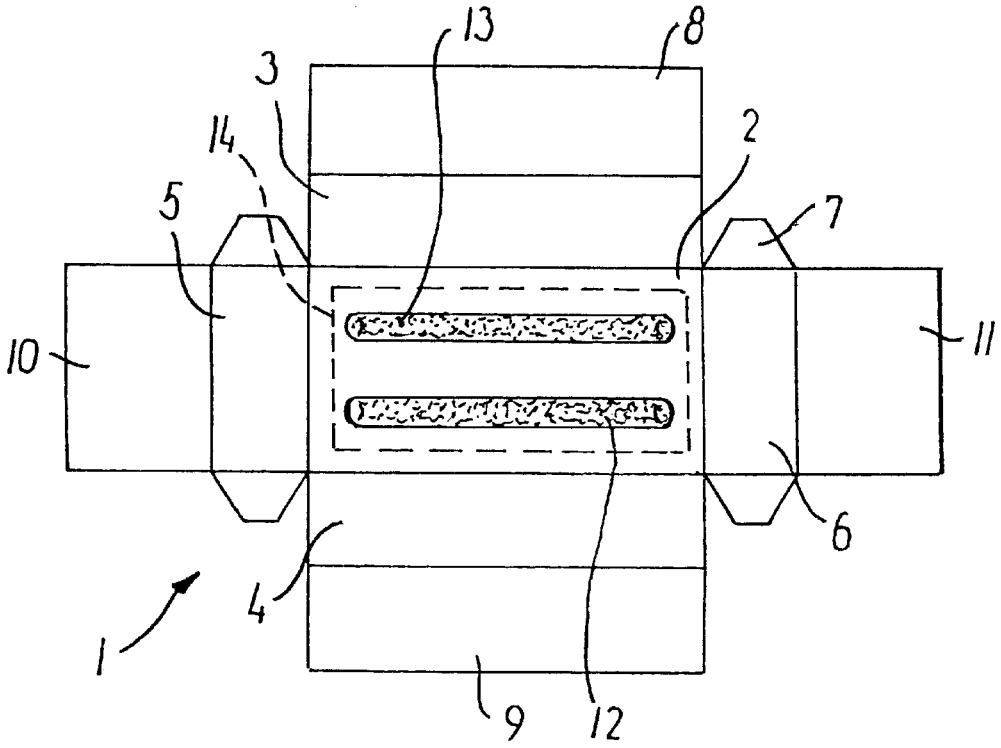

METHOD FOR SHOCK-RESISTANT PACKAGING OF A PRODUCT AND A PLANE CARDBOARD BLANK FOR CARRYING OUT THE METHOD

A method for shock-resistant packaging of a product and a plane cardboard blank for carrying out the method.

The present invention relates to a method for shock-resistant packaging of a product in an essentially box-shaped cardboard packing comprising the steps of local application of an adhesive layer to a base surface of the cardboard packing, bringing the product into contact with the adhesive layer and closing the packing.

For a number of different products which during transport and handling should be protected against mechanical damage in the form of impact loads, it is well-known to provide a shock-resistant packaging in a box-shaped cardboard packing permitting a piled and organized transport and storage, also for products which per se have a somewhat irregular form.

In conventional packaging of this kind, an inner packing usually corresponding to the inner shape of the cardboard packing is used in the form of shells or blocks from a workable material, in particular foamed plastics such as polystyrene, because such shells and blocks can be shaped to fit the outer contour of the packed product. The product is thus situated securely in the cardboard packing, and a good mechanical protection is hereby obtained. However, this form of packaging has the inconvenience that due to the use of particularly shaped inner packing elements, it is relatively expensive and, at the same time, rather time-consuming as both packaging and unpacking of the product must as a rule be carried out manually. The storage of the inner packing implies a larger need for storage yard, and the disposal of the inner packing after use entails expenses and an increased environmental impact.

From U.S. Pat. No. 3,891,090 it is known to pack various form of products, especially those of a minor size in a box-shaped cardboard packing in which a tubular inner packing element of heat-shrinkable plastic film is adhesively affixed to a base surface. Upon arrangement of the product in this inner packing element, the heat shrinkable tube is upon application of heat made to tightly encompass the product. However, the need for heat application results in an additional process in the packaging.

A similar packaging method is disclosed in U.S. Pat. No. 4,757,900 where the heat-shrinkable inner packing element is fastened to the outer surfaces of the cardboard packing.

EP-A-0 686 577 discloses a method for preparing a plant package for transport and delivery, by which a number of floral containers in the form of pot means or vases are formed individually from sheet material such laminated polypropylene films and are subsequently at their bases connected to a support structure formed by the bottom of a box-shaped carton packing.

The object of the invention is to provide a method which in relation to the above known packing methods implies a substantial simplification and price reduction.

The method according to the invention is therefore characterized in that the adhesive layer is applied to a base surface portion of a plane foldable cardboard blank, that the product is placed on said portion, while the cardboard blank is in a plane condition and that subsequently the blank is folded up to form the cardboard packing.

Hereby, the need for production of a special inner packing adapted to the product is avoided, and the number of work operations both in packaging and unpacking are minimized.

The placement of the product directly on the plane cardboard blank prior to its folding-up makes the method according to the invention particularly usable for shock-resistant packing of products on an industrial scale as plane cardboard blanks with applied adhesive layer may for instance be conveyed automatically on a belt conveyor which at a packing station receives the products piece by piece.

Due to the proper stiffness of the box-shaped cardboard packing, both the protection of the packed products against mechanical impact and the possibility of a piled and organized placement of packed products during storage and transport are essentially equal to what can be obtained by the known packing methods, the retaining of the packed product to the adhesive layer on the base portion of the cardboard packing per se resulting in a secure localization of the product in the cardboard packing.

Moreover, by the folding-up of the parts of the cardboard blank surrounding the base surface, on which the product is placed, an air buffer zone is provided between the product and the walls of the finished box-shaped packing.

Advantageous embodiments of the method are stated in the dependant claims 2–9.

In a preferred implementation of the method, the product is completely wrapped with a barrier material prior to positioning on the adhesive layer. In particular, by use of an elastic barrier layer, such as a film material, a further improvement of the shock absorption provided due to deformability of the box-shaped packing and by the adhesive layer itself is obtained.

The invention further relates to a packing material for use in the method comprising a plane cardboard blank which is foldable to provide an essentially box-shaped cardboard packing, characterized in that an adhesive layer to be activated selectively is provided to a protion of the cardboard blank, which by folding of the blank into said cardboard packing will provide a base surface thereof.

By an adhesive layer to be activated selectively is here meant an adhesive layer which can beforehand be applied on the plane cardboard blank, but the adhesive properties of which are not activated until the method for packing of a product is carried out.

In a preferred embodiment of this plane cardboard blank, the applied adhesive layer comprises an outward adhesive tape covered by a removable protection layer.

The invention thereby offers the possibility of producing plane cardboard blanks an separate packing units for use both in connection with industrial packaging and in private households.

Figure 6:
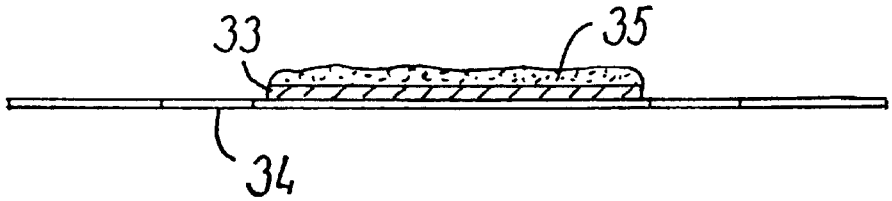
Figure 3:
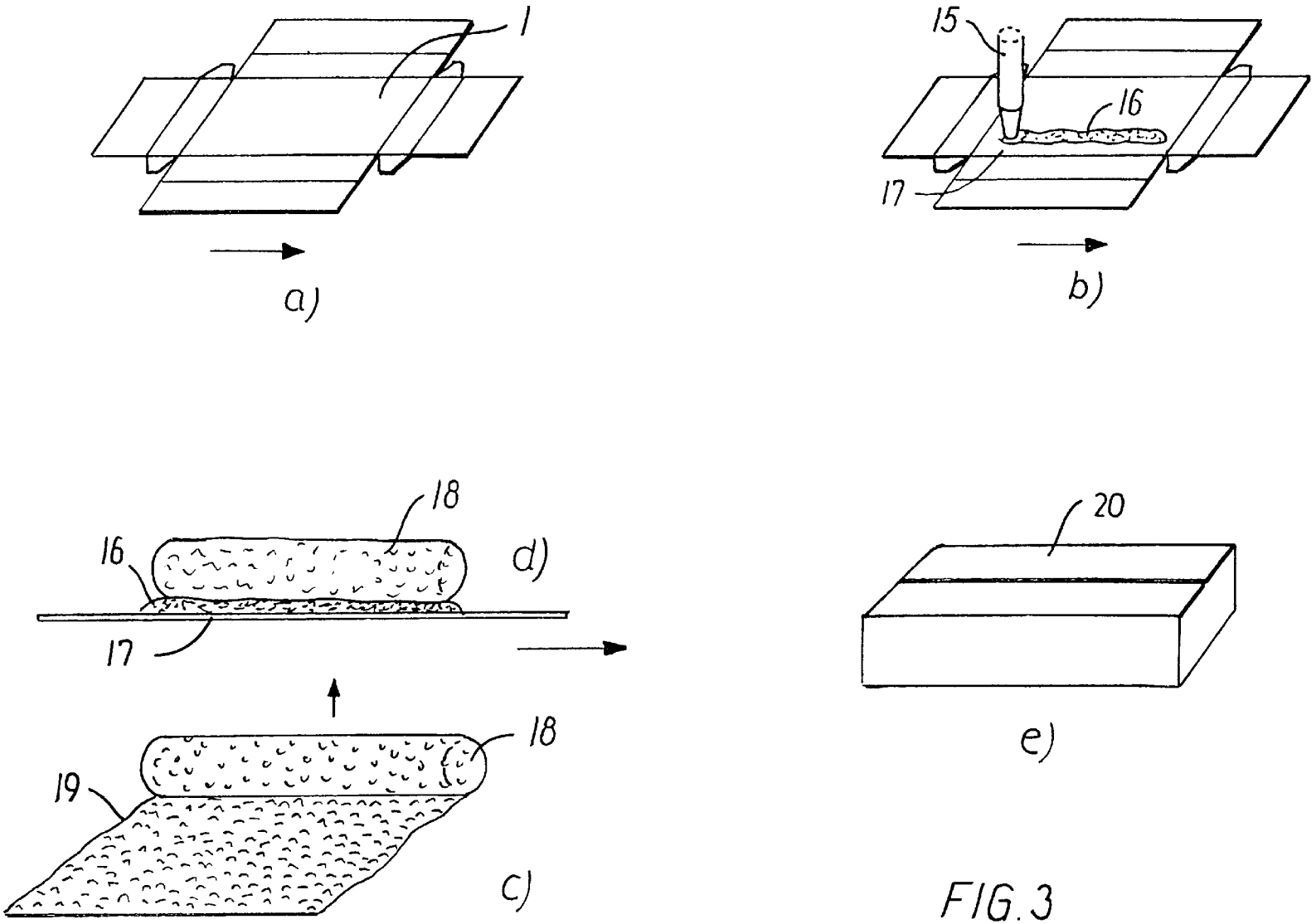
Figure 4:
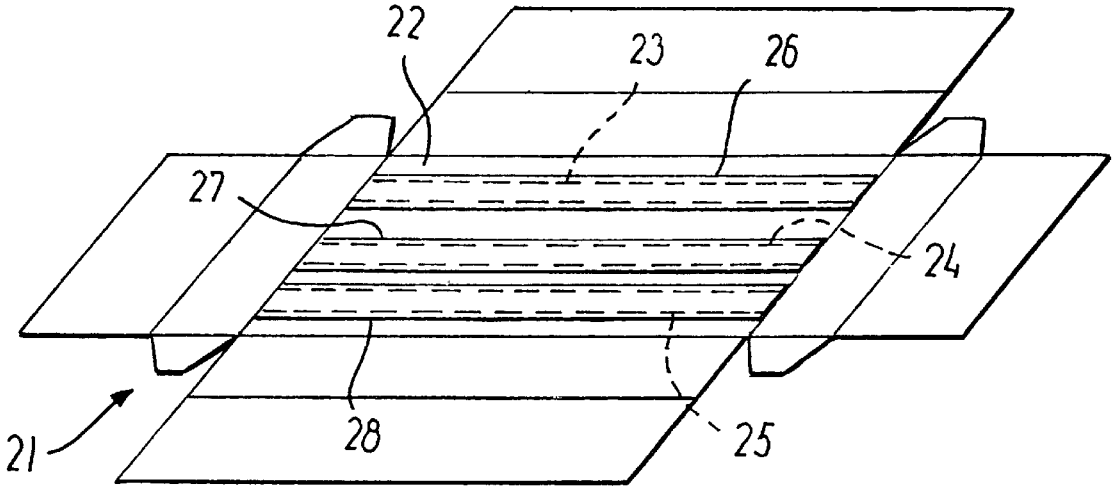
Figure 5:
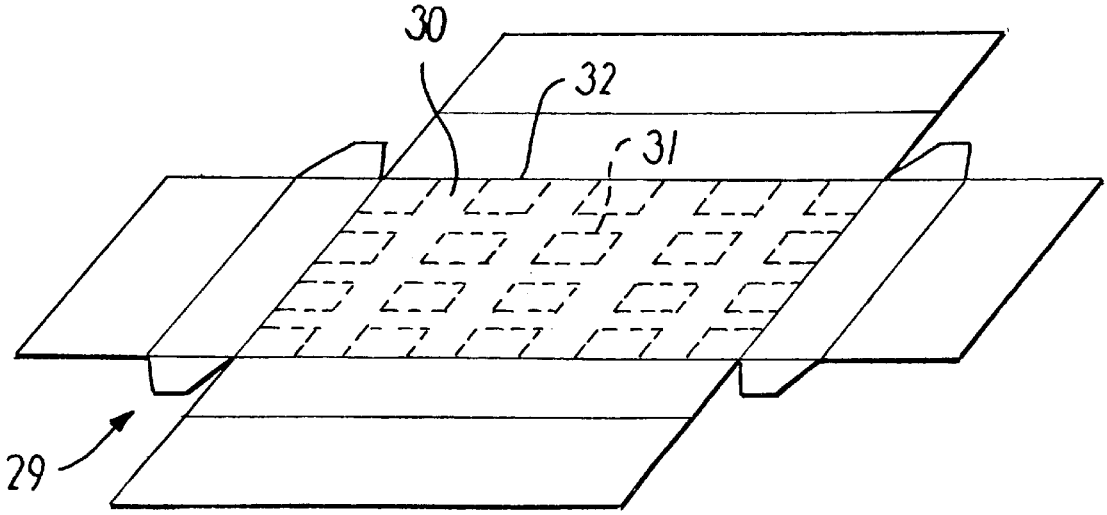

In the following, the invention is explained more in detail with reference to the schematic drawing, where FIGS. 1 and 2 in a plane view and a side view illustrate secured localization of a product to be packed on a plane cardboard blank prior to folding up thereof, FIGS. 3*a*)–*e*) illustrate an embodiment of the method according the invention, FIGS. 4 and 5 are plane views of embodiments of a plane cardboard blank with an adhesive layer in the form of adhesive tapes, and FIG. 6 is a side view of a modified embodiment.

Figure 2:
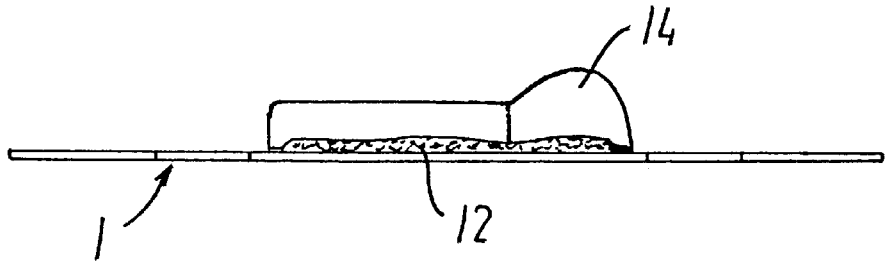

FIGS. 1 and 2 show a plane cardboard blank 1 with a base portion 2 intended to form a bottom in a box-shaped cardboard packing provided by folding up the blank.

The base portion or bottom wall 2 is by folding lines connected with further elements of the plane cardboard blank 1 comprising side walls 3 and 4 and end walls 5 and 6 of which the latter are provided with projecting adhesive flaps 7.

Each of the side walls 3 and 4 and of the end walls 5 and 6 is further connected with an element respectively 8, 9, 10 and 11 which elements together are intended to form a lid in the finished cardboard packing.

In the shown example, two tape-shaped adhesive layers 12 and 13 are applied on the base portion or bottom wall 2. The adhesive layers 12 and 13 are here applied in a liquid state on the base portion 2, a foamed adhesive compound as e.g. a hot-melt adhesive being appropriately used for this purpose. The product 14 to be packed is in FIGS. 1 and 2 an accessory part for a roof window in the form of a roller shutter, however, this is of course in no way limiting for the invention which can be used for packing of an infinitude of various products.

As shown in FIG. 3, the method according to the invention can comprise the following treatment steps. In 3*a*) the plane cardboard blank 1 is conveyed in a linear movement which can e.g. be effected by means of a belt or roller conveyor (not shown). In 3*b*) the plane cardboard blank 1 passes an adhesive application device 15 where one or more layers of adhesive 16, e.g. as described above, are applied in a liquid state on the base portion 17 of the blank 1.

The product 18 to be packed is in the shown example of 3*c*) wrapped completely with a plastic film 19, which can e.g. be a blister foil in order to obtain a particularly good mechanical protection. However, this is no necessary feature of the method, as the product can be protected in another way against direct contact with the adhesive 16, e.g. by means of a soluble protection layer, wax or similar coatings. In 3*d*) the product 18 is placed on the base portion 17 of the plane cardboard blank 1 with the wrapped film 19 in direct adhesive contact with the adhesive layer 16.

Finally, in 3*e*), the plane cardboard blank 1 is folded up by bending the different elements of the blank along the previously formed folding lines whereby a box-shaped packing 20 is produced in which the product 18 is localized in a secure manner and fastened to the base portion 17.

As shown in plane views in FIGS. 4 and 5, a plane cardboard blank can by carrying out the method according to the invention be produced as a separate packing unit for a number of different packing purposes.

FIG. 4 shows thus an example where on the base portion 22 of the plane cardboard blank 21, three adhesive layers 23, 24 and 25 are applied in the form of adhesive tapes, e.g. doubly adhesive, with an outward adhesive face, where each of the adhesive tapes is covered by a removable protection layer, e.g. in the form of paper ribbons 26–28.

Especially in cases where several products are to be placed in one packing cardboard, it may, as shown in FIG. 5, be appropriate to use a larger part of the base portion 30 of the plane cardboard blank 29 for placement of adhesive layers in the form of adhesive tapes 31, e.g. as shown in a window pane pattern covering the entire area of the base portion 30 whereby the adhesive tapes 31 can appropriately be covered by a common protective layer 32.

As illustrated in the side view in FIG. 6, improved shock resistance may be obtained by application of a shock-absorbing layer 33, e.g. of foam or gel-like material, to the base surface 34 of the packing before application of the adhesive layer 35.

What is claimed is:

1. A method for shock-resistant packaging of a product (14, 18) of irregular form, characterized by the steps of providing a single, coherent, plane foldable cardboard packing member having a base surface portion and side and end wall forming elements;

locally applying an adhesive layer to the base surface portion of said cardboard packing member;

positioning the product (14, 18) into contact with said adhesive layer (12, 13, 16, 23–25, 31) to be retained thereby for secure localization, while said cardboard packing member (1) is in its plane condition; and erecting said side and end wall forming elements of said cardboard packing member into a folded-up essentially box-shaped packing.

2. A method according to claim 1, characterized in that prior to being brought into contact with the adhesive layer (16), the product (18) is wrapped with a barrier material (19) such that this completely envelops the product.

3. A method according to claim 2, characterized in that said barrier material (19) is a film material.

4. A method according to claim 1, characterized in that the adhesive layer (12, 13, 16) is applied in a liquid state.

5. A method according to claim 4, characterized in that a foamed adhesive compound is used for applying the adhesive layer (12, 13, 16).

6. A method according to claim 5, characterized in that as an adhesive compound is used a hot-melt adhesive.

7. A method according to claim 1, characterized in that the adhesive layer is applied in the form of at least one adhesive tape (23–25, 31) being adhesive on the outward side.

8. A method according to claim 7, characterized by the use of a double-adhesive tape (23–25, 31).

9. A method according to claim 1, characterized by the application of a shock-absorbing layer to the base surface before application of the adhesive layer.

10. A packing material for packaging a product for use in the method of locally applying an adhesive layer to a base surface portion of a plane, foldable cardboard packing and positioning the product (14, 18) into contact with said adhesive layer (12, 13, 16, 23–25, 31) while said cardboard packing (1) is in its plane condition; and erecting side and end wall forming elements of said cardboard packing into a folded-up essentially box-shaped packing, wherein the packing material includes a single, coherent, plane cardboard blank having a base surface portion and side and end wall forming elements, foldable to provide an essentially box-shaped cardboard packing, characterized in that an adhesive layer (23–25, 31) to be activated selectively is provided on to said base surface portion of the cardboard packing member to retain said product for secure localization in said cardboard packing.

11. A packing material according to claim 10, characterized in that said adhesive layer comprises at least one adhesive tape (23–25, 31) with an outward adhesive surface covered by a removable protective layer (26–28, 32).

* * * * *